United States Patent [19]

Kouno et al.

[11] Patent Number: 5,034,572

[45] Date of Patent: Jul. 23, 1991

[54] SWITCH DEVICE

[75] Inventors: Yasuhiro Kouno; Shouji Ishida; Harumi Doke, all of Aichi, Japan

[73] Assignee: Kabushiki Kaisha Tokai Rika Denki Seisakusho, Aichi, Japan

[21] Appl. No.: 499,645

[22] Filed: Mar. 27, 1990

[30] Foreign Application Priority Data

Mar. 29, 1989 [JP] Japan ..... 1-35718[U]

[51] Int. Cl.[5] ..... H01H 9/00; H01H 13/70; H01H 25/04

[52] U.S. Cl. ..... 200/5 R; 200/6 A

[58] Field of Search ..... 200/5 R, 5 A, 6 A, 17 R, 200/18, 50 C, 16 C, 16 D; 350/637

[56] References Cited

U.S. PATENT DOCUMENTS

| | | | |
|---|---|---|---|
| 4,499,342 | 2/1985 | Nakayama | 200/5 R X |
| 4,590,338 | 5/1986 | Suzuki | 200/5 R |
| 4,611,102 | 9/1986 | Ishida | 200/5 R |
| 4,698,463 | 10/1987 | Tanaka et al. | 200/5 R |
| 4,861,950 | 8/1989 | Yanai et al. | 200/5 R |
| 4,937,402 | 6/1990 | Kyoden | 200/5 R |
| 4,947,461 | 8/1990 | Yoshioka et al. | 200/5 R |
| 4,975,547 | 12/1990 | Nakayama et al. | 200/5 R |

*Primary Examiner*—J. R. Scott

*Attorney, Agent, or Firm*—Finnegan, Henderson, Farabow, Garrett, and Dunner

[57] ABSTRACT

In a switch device in which four switches are operated by depression of four depressing surfaces which are defined by diagonal lines on a rectangular operating knob, the four switches comprise: four principal contact assemblies which are each arranged in such a manner as to be aligned with one of the depressing surfaces to form part of the switches, and each respective principal contact assembly is turned on when the corresponding depressing surface is depressed; and two common contact assemblies which are arranged at substantially opposite ends of one of the diagonal lines of the operating knob in such a manner that each of the two common contact assemblies is aligned with two adjacent ones of the depressing surfaces to form part of two adjacent switches, and each common contact assembly is turned on by depression of any one of the two adjacent depressing surfaces, which results in a switch device that is simple in construction and low in manufacturing cost.

20 Claims, 5 Drawing Sheets

SWITCH DEVICE

BACKGROUND OF THE INVENTION

This invention relates to a switch device which, for example, is suitable for remotely controlling an electric motor which is used to change the position of an outside mirror of an automobile (hereinafter referred to merely as "a switch device", when applicable).

A switch device of this type is, for instance, designed so that four depressing surfaces defined on a plate-shaped operating knob are depressed to activate two electric motors to swing the mirror vertically and horizontally. One example of a switch device of this type is shown in FIG. 9. The switch device has four depressing surfaces including four switches 1, 2, 3 and 4 which are so arranged that the switches 1 and 2 are opposite one another and the switches 3 and 4 are opposite one another. The switches 1, 2, 3 and 4 comprise contact means 1*a* and 1*b*, 2*a* and 2*b*, 3*a* and 3*b*, and 4*a* and 4*b*, respectively. When the contact means 1*a* and 1*b* are turned on simultaneously by operating the "UP" push button, the switch 1 is operated so that a motor adapted to swing the mirror vertically is turned in the forward direction, to swing the mirror upwardly. When the contact means 2*a* and 2*b* are turned on simultaneously by operating the "DOWN" push button, the switch 2 is operated to turn the motor in the reverse direction to swing the mirror downwardly. When the contact means 3*a* and 3*b* are turned on simultaneously by operating the "LEFT" push button, the switch 3 is operated so that a motor adapted to swing the mirror horizontally is turned in the forward direction to swing the mirror to the left. Similarly, when the contact means 4*a* and 4*b* are turned on simultaneously by operating the "RIGHT" push button, the switch 4 is operated so that the motor is turned in the reverse direction to swing the mirror to the right.

Of those eight contact means, the contact means 1*a* and 3*a* are used to connect a common terminal of the vertically swinging motor and the horizontally swinging motor to the negative terminal of a battery, and the contact means 2*a* and 4*a* are used to connect a common terminal of the motors to the positive terminal of the battery. The contacts 1*a* and 3*a* are provided adjacent to each other, and the contacts 2*a* and 4*a* are also provided adjacent to each other.

In the above-described conventional switch device, eight contacts means, 1*a* through 4*a* and 1*b* through 4*b*, are provided to form the four switches 1 through 4. The number of contact means is relatively large. As a result, the switch device is intricate in construction and high in manufacturing cost.

SUMMARY OF THE INVENTION

Accordingly, an object of the invention is to eliminate the above-described difficulties accompanying a conventional switch device.

More specifically, an object of the invention is to provide a switch device which has a smaller number of contact means than a conventional switch device, and is accordingly simpler in construction and lower in manufacturing cost.

The foregoing object and other objects of the invention have been achieved by the provision of a switch device comprising: a first rectangular operating knob provided on one surface of a switch casing in such a manner that the operating knob is displaceable and slightly rotatable by depression, the operating knob having four depressing surfaces defined by diagonal lines; and four switches arranged inside the switch casing in such a manner that the switches are operated by depression of the four depressing surfaces. According to the invention, the four switches comprise: four principal contact means which are each arranged in such a manner as to be aligned with one of the depressing surfaces to form part of the switches, and each respective principal contact means is turned on when the corresponding depressing surface is depressed; and two common contact means which are arranged at substantially opposite ends of one of the diagonal lines of the operating knob in such a manner that each of the two common contact means is aligned with two adjacent ones of the depressing surfaces to form part of two adjacent switches, and each common contact means is turned on by depression of any one of the two adjacent depressing surfaces.

In the switch device of the invention, the two common contact means are designed so that each is commonly provided for two switches and can be operated by depression of any one of two adjacent depressing surfaces. Therefore, the four switches can be formed with six contact means instead of eight contact means which were heretofore required to form them. As a result, the switch device of the invention is simpler in construction and lower in manufacturing cost.

The nature, principle and utility of the invention will become more apparent from the following detailed description when read in conjunction with the accompanying drawings, in which like parts are designated by like reference numerals or characters.

DETAILED DESCRIPTION OF THE PREFERRED EMBODIMENT

Figure 1:
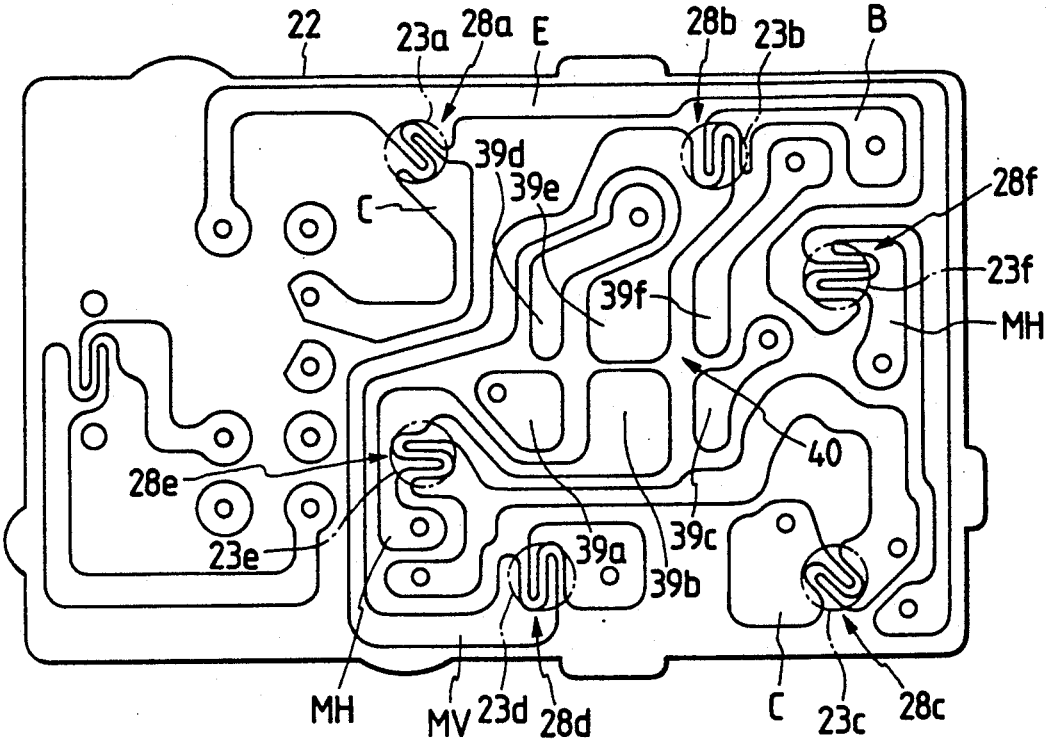
FIG. 1 is a plan view of an insulating substrate in one example of a switch device according to this invention.
Figure 2:
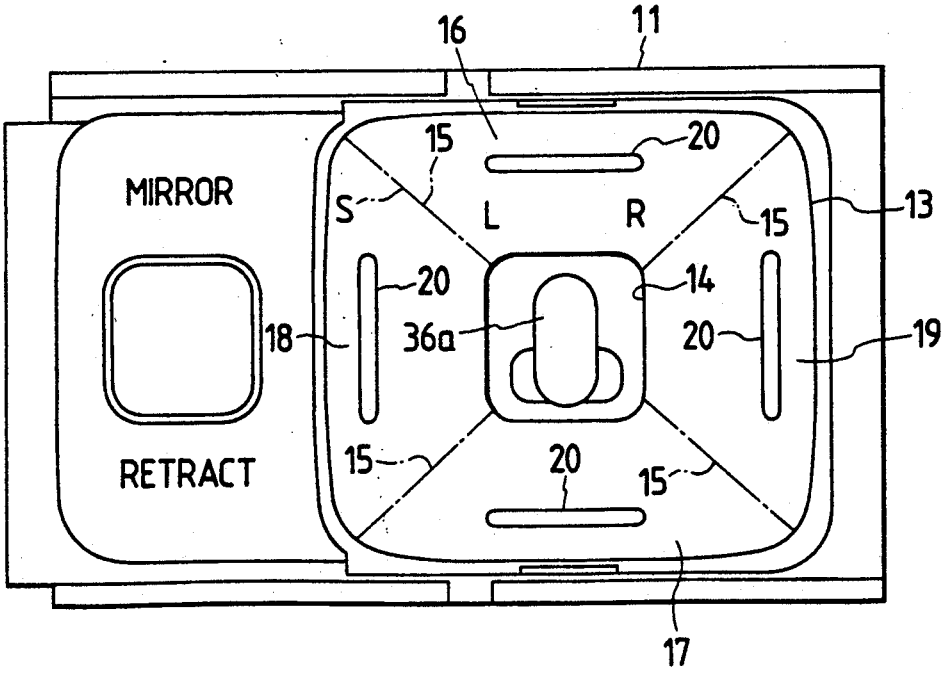
FIG. 2 is a front view of the switch device.

One example of a switch device according to this invention, which, for example, is suitable for remotely controlling electric motors which are adapted to swing an outside mirror of an automobile vertically and horizontally, will be described with reference to FIGS. 1 through 9.

In those figures, reference numeral 11 designates a switch casing in the form of a rectangular box with the top and bottom open. The switch casing 11 has a step 12 on the inner surface of its front wall, and a square operating knob 13 which is relatively flat and has a square opening 14 at the center. A flange 13*b* is extended outwardly from the lower edge of the peripheral wall 13*a* of the operating knob 13. The operating knob 13 is positioned so as to appear on the front side of the switch casing 11 with the flange 13*b* engaged with the step 12 of the casing 11. Four depression surfaces 16 through 19 defined by four lines 15 are provided on the front surface of the operating knob 13. The depression surfaces 16 through 19 each have display means 20. The operating knob 13 has six cylindrical depressing parts 21 on its rear side which are formed integral with the operating knob 13 in such a manner that they positionally correspond to contact means (described later).

Figure 6:
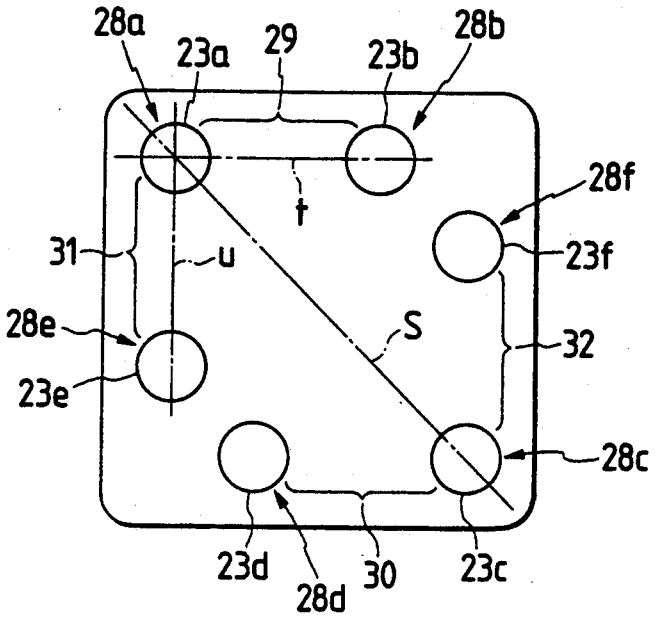
FIG. 6 is an explanatory diagram showing the arrangement of switches in the switch device of the invention.
Figure 7:
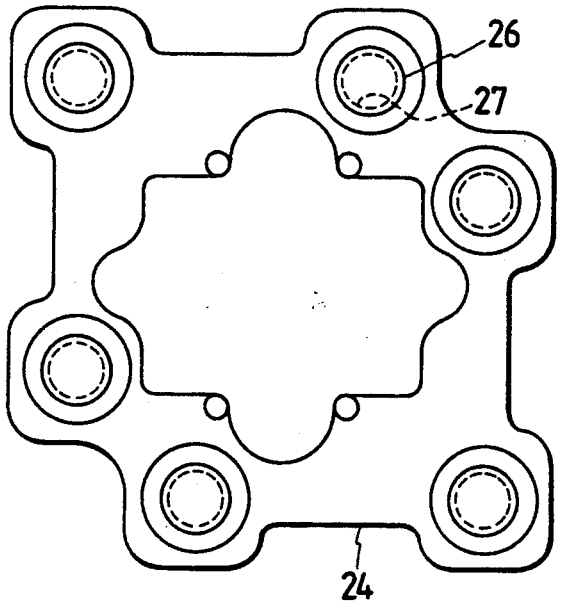
FIG. 7 is a plan view showing a contact supporting member in the switch device.

Further in the figures, reference numeral 22 designates an insulating substrate 22, or printed circuit board, which is fixedly fitted in the rear end portion of the casing 11. Six stationary contact regions 23*a* through 23*f* are formed on the upper surface of the substrate 22 in correspondence to the depressing parts 21 by print patterning as shown in FIG. 1 or 6. Reference numeral 24 designates a contact supporting member of elastic material such as rubber which is laid on the upper surface of the insulating substrate 22. The contact supporting member 24 has movable portions 26, each in the form of a short cylinder at positions corresponding to the depressing parts 21. The movable portions 26 are each surrounded by annular thin portions 25. Normally the movable portions 26 are spaced away from the stationary contact regions 23*a* through 23*f* by the elastic forces of the thin portions 25. Movable contacts 27 are formed on each of the movable portions. More specifically, the movable contacts 27 are metal plates bonded to the surfaces of the movable portions 26 which are aligned with the stationary contact regions 23*a* through 23*f*. The movable contacts 27 and the stationary contact regions 23*a* through 23*f* provide contact means 28*a* through 28*f*, respectively. The contact means 28*b*, 28*d*, 28*e* and 28*f* are principal contact means, and the contact means 28*a* and 28*c* are principal contact means, and the contact means 28*a* and 28*c* are common contact means. The principal contact means 28*b* is aligned with the "UP" depressing surface 16, so that it is turned on when the depressing surface 16 is depressed. The principal contact means 28*d* is aligned with the "DOWN" depressing surface 17, so that it is turned on when the depressing surface 17 is depressed. The principal contact means 28*e* is aligned with the "LEFT" depressing surface 18, so that it is turned on when the depressing surface 18 is depressed. The principal contact means 28*f* is aligned with the "RIGHT" depressing surface 19, so that it is turned on when the depressing surface 19 is depressed. The common contact means 28*a* and 28*c* are positioned at substantially opposite ends of one diagonal line of the operating knob. Thus, the common contact means 28*a* is turned on when either the "UP" depressing surface 16 is depressed, or when the "LEFT" depressing surface 18 is depressed. The common contact means 28*c* is turned on when either the "DOWN" depressing surface 17 is depressed or when the "RIGHT" depressing surface 19 is depressed. The contact means 28*a* and 28*b* form an "UP" switch 29, the contact means 28*c* and 28*d* form a "DOWN" switch 30, the contact means 28*a* and 28*e* form a "LEFT" switch 31, and the contact means 28*c* and 28*f* form a "RIGHT" switch 32.

An inner casing 33 is accommodated in the switch casing 11 in such a manner as to be aligned with the opening 14 of the switch casing 11. The inner casing 33 is supported by a rectangular supporting frame 35 through ribs 34 extending along one diagonal line of the switch casing 11. The inner casing 33, the supporting frame 35, and the ribs 34 form one unit. The supporting frame 35 is fixedly fitted in the switch casing 11. A movable contact holder 36 is slidably provided inside the inner casing 33. In the movable contact holder 36, armatures 38*a* and 38*b* are supported through springs 37. Six stationary contacts 39*a* through 39*f* are provided on the upper surface of the insulating substrate 22 in such a manner as to be able to engage the armatures 38*a* and 38*b*. The armatures 38*a* and 38*b* and the stationary contacts 39*a* through 39*f* form a slide switch 40. The movable contact holder 36 has a control 36*a* which protrudes through the opening 14 of the switch casing 11.

Flanges 41 extend from two opposite sides of the front portion of the inner casing 33. A rectangular-frame-shaped regulating member 42 is mounted on the flanges 41 in such a manner that it is slidable in the switch casing. The regulating member 42 has tapered depression regulating portions 42*a* through 42*d* which are its four sides. The operating knob has four operating protrusions 13*c* through 13*f* on its rear side in such a manner that the operating protrusions 13*c* through 13*f* are aligned with the depression regulating portions 42*a* through 42*d*, respectively.

Figure 8:
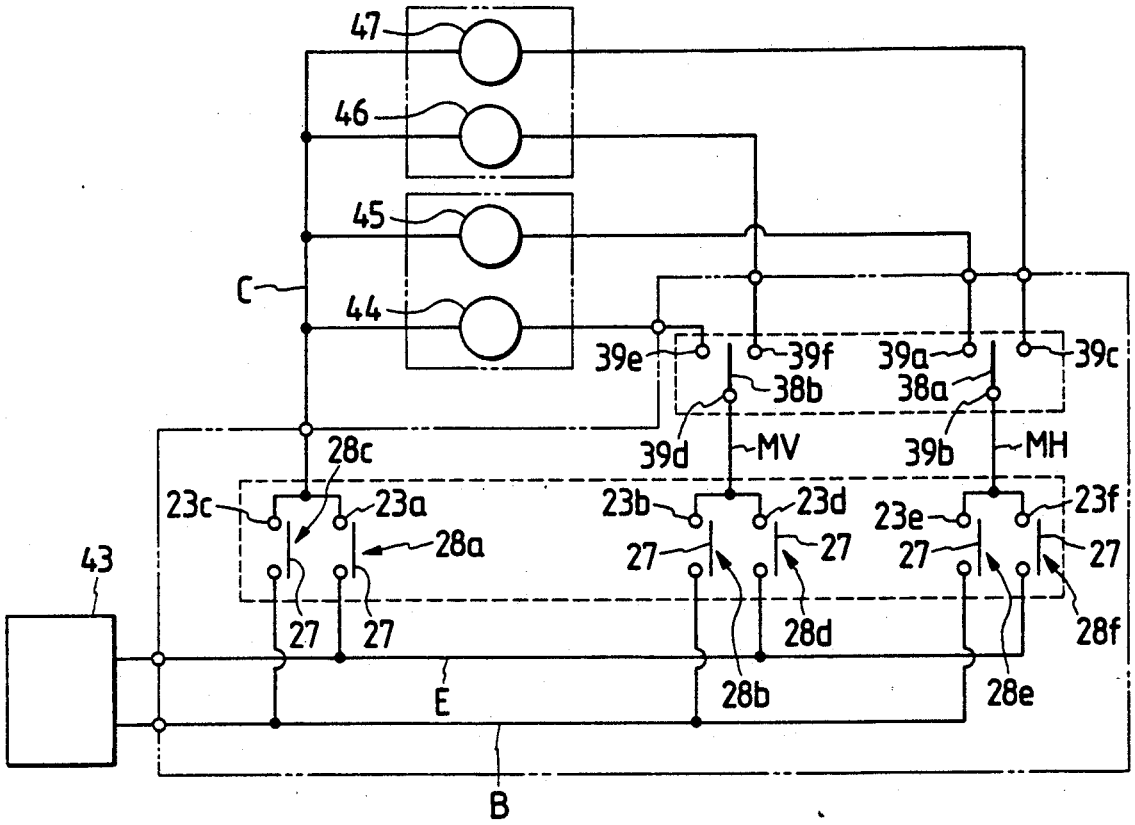
FIG. 8 is a circuit diagram of the switch device of the invention.
Figure 9:
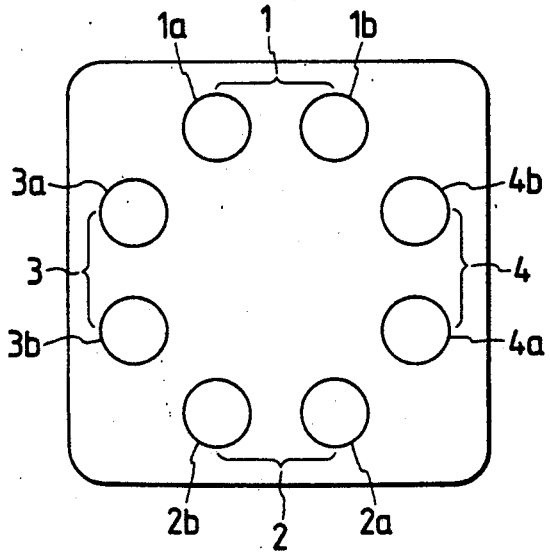
FIG. 9 PRIOR ART
FIG. 9 is an explanatory diagram showing the arrangement of switches in a conventional switch device.

FIG. 8 is a circuit diagram of the switch device. In FIG. 8, reference numeral 43 designates a battery, and reference numerals 44, 45, 46 and 47, designate electric motors. The motor 44 is used to swing the left mirror vertically, and the motor 45 is used to swing the left mirror horizontally. The motor 46 is used to swing the right mirror vertically, and the motor 47 is used to swing the right mirror horizontally. In FIG. 8, reference characters B, E, C, MV and MH designate lines which are formed on the insulating substrate 22 shown in FIG. 1.

The operation of the switch device thus constructed will be described.

When the control 36*a* of the slide switch 40 is moved to the left, the left outside mirror is selected with the stationary contacts 39*e* and 39*d* connected through the armature 38*b* and with the stationary contacts 39*a* and 39*b* connected through the armature 38*a*.

When, under this condition, the "UP" depressing surface 16 is depressed, the movable portions 26 corresponding to the contact means 28*a* and 28*b* are elastically deformed through the thin portions 25 by the depressing parts 21 provided on the rear side of the operating knob 13. Deforming the movable portions 26 corresponding to the contact means 28*a* and 28*b* causes the corresponding movable contacts 27 to be brought into contact with the stationary contact regions 23*a* and 23*b*, respectively, whereby the contact means 28*a* and 28*b* are turned on simultaneously, that is, the switch 29 is turned on. As a result, the line C is electrically connected through the line E to the negative terminal of the battery 43, while the line MV is electrically connected through the line B to the positive terminal of the battery 43, so that the motor 44 is rotated in the forward direction to swing the mirror (not shown) upwardly.

When the "DOWN" depressing surface 17 is depressed, the movable portions 26 corresponding to the contact means 28*c* and 28*d* are elastically deformed by through the thin portions 25 by the depressing parts 21 of the operating knob 13. Deforming the movable portions 26 corresponding to the contact means 28*c* and 28*d* causes the corresponding movable contacts 27 to be brought into contact with the stationary contact regions 23*c* and 23*d*, whereby the contact means 28*c* and 28*d* are turned on simultaneously, that is, the switch 30 is turned on. As a result, the line C is electrically connected through the line B to the positive terminal of the battery 43, while the line MV is electrically connected through the line E to the negative terminal of the battery 43, so that the motor 44 is rotated in the reverse direction to swing the mirror (not shown) downwardly.

When the "LEFT" depressing surface 18 of the operating knob 13 is depressed, the movable portions 26 corresponding to the contact means 28*a* and 28*e* are elastically deformed through the thin portions 25 by the depressing parts 21 of the operating knob 13. Deforming the movable portions 26 corresponding to the contact means 28*a* and 28*e* causes the corresponding movable contacts 27 to be brought into contact with the stationary contact regions 23*a* and 23*e*, respectively, whereby the contact means 28*a* and 28*e* are turned on, that is, the switch 31 is turned on. As a result, the line C is electrically connected through the line E to the negative terminal of the battery 43, while the line MH is electrically connected through the line B to the positive terminal of the battery 43, so that the motor 45 is rotated in the forward direction to swing the mirror (not shown) to the left.

When the "RIGHT" depressing surface 19 of the operating knob 13 is depressed, the movable portions 26 corresponding to the contact means 28*c* and 28*f* are elastically deformed through the thin portions 25 by the depressing parts 21 of the operating knob 13. Deforming the movable portions 26 corresponding to the contact means 28*c* and 28*f* causes the corresponding movable contacts 27 to be brought into contact with the stationary contact regions 23*c* and 23*f*, respectively, so that the contact means 28*c* and 28*f* are turned on simultaneously, that is, the switch 32 is turned on. As a result, the line C is connected through the line B to the positive terminal of the battery 43 while the line MH is electrically connected through the line E to the negative terminal of the battery 43, so that the motor 45 is rotated in the reverse direction to swing the mirror (not shown) to the right.

Figure 3:
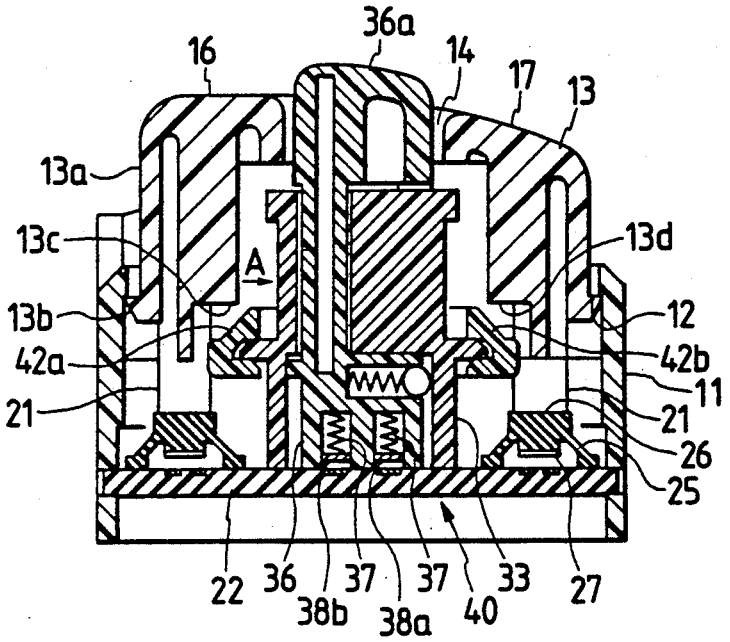
FIG. 3 is a cross-sectional view of the switch device.
Figure 4:
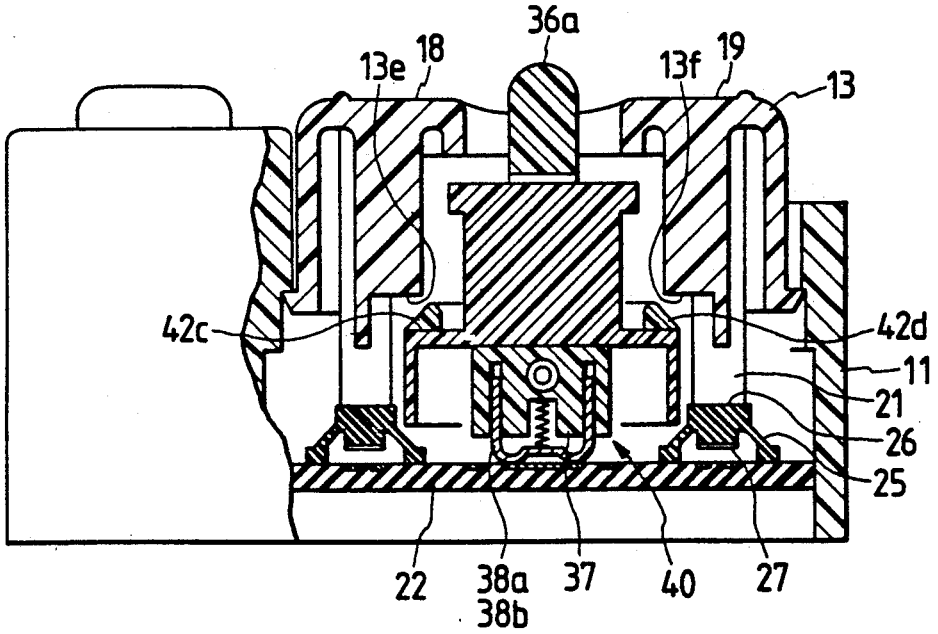
FIG. 4 is a bottom view, with parts cut away, showing the switch device.
Figure 5:
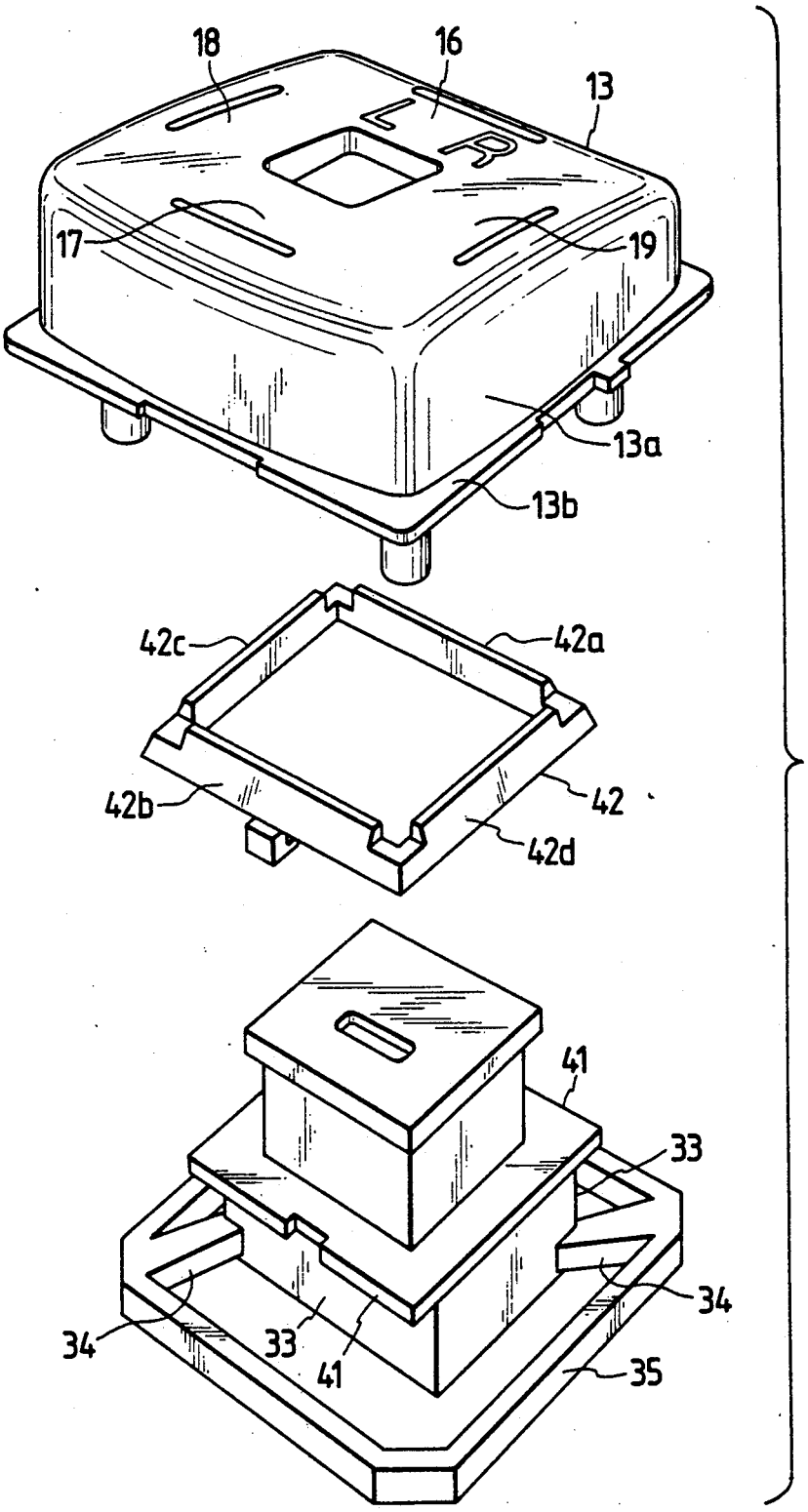
FIG. 5 is an exploded view showing essential components of the switch device.

When the depressing surface 16 of the operating knob 13 is depressed, the operating protrusion 13*c* is abutted against the depression regulating portion 42*a* of the regulating member 42, to move the latter 42 in the direction of the arrow A in FIG. 3. Therefore, the operating protrusion 13*d* aligned with the depressing surface 17 is abutted against the depression regulating portion 42*b*, thereby preventing the depression of the depressing surface 17. When the depressing surface 17 of the operating knob 13 is depressed, the operating protrusion 13*d* is abutted against the depression regulating portion 42*b* of the regulating member 42, to move the latter 42 in the opposite direction. Therefore, the operating protrusion 13*c* aligned with the, depressing surface 16 is abutted against the depression regulating portion 42*a*, thereby preventing the depression of the depressing surface 16. Similarly, when the depressing surface 18 is depressed, the depression of the depressing surface 19 is prevented by the regulating member 42, and when the depressing surface 19 is depressed, the depression of the depressing surface 18 is prevented.

When the control 36*a* of the slide switch 40 is operated to the right, the stationary contacts 39*e* and 39*f* and the stationary contacts 39*b* and 39*c* are connected through the armatures 38*b* and 38*a*, respectively, so that the right outside mirror is selected. When the switches 29 through 32 are turned on, instead of the motors 44 and 45, the motors 46 and 47 are operated in the same manner as described above.

In the above-described embodiment, the four switches 29 through 32 are made up of the six contact means 28*a* through 28*f*. The four principal contact means 28*b*, 28*d*, 28*e* and 28*f* are aligned with the depressing surfaces 16, 17, 18 and 19, respectively. The common contact means 28*a* is aligned with the depressing surfaces 16 and 18, and the common contact means 28*c* is aligned with the depressing surfaces 17 and 19. Hence, the switch device of the invention is simpler in construction and lower in manufacturing cost than the conventional switch device in which the four switches are made up of eight contact means.

In the above-described embodiment, the common contact means 28*a* and 28*c* are positioned at substantially opposite ends of one of the diagonal lines of the operating knob 13. Therefore, for instance, the contact means 28*a* and 28*b* which are turned on simultaneously by depression of the depressing surface 16 are positioned on a straight line, t, which is in parallel with two opposite sides of the operating knob 13. Accordingly, when the contact means 28*a* and 28*b* are turned on by depression of the depressing surface 16 to turn on the switch 29, the depressing surface 16, not being tilted with respect to the outer casing 11, can be depressed smoothly. Similarly, the contact means 28*a* and 28*e* which are turned on simultaneously by depression of the depressing surface 18, are positioned on a straight line, u, which is in parallel with the other two opposite sides of the operating knob 13. Accordingly, when the contact means 28*a* and 28*e* are turned on simultaneously by depression of the depressing surface 18 to turn on the switch 31, the depressing surface 18, not being tilted with respect to the outer casing 11, can be depressed smoothly. The same thing can be said about the other depressing surfaces 17 and 19.

As was described above, in the switch device comprising: the flat rectangular operating knob provided on one surface of the switch casing in such a manner that the operating knob is displaceable and slightly rotatable by depression, the operating knob having four depressing surfaces defined by diagonal lines; and the four switches arranged inside the switch casing in such a manner that the switches are operated by depression of the four depressing surfaces. According to the invention, the four switches comprise: four principal contact means which are each arranged in such a manner as to be aligned with one of the depressing surfaces to form part of the switches, and each respective principal contact means is turned on when the corresponding depressing surface is depressed; and two common contact means which are arranged at substantially opposite ends of one of the diagonal lines of the operating knob in such a manner that each of the two common contact means is aligned with two adjacent ones of the depressing surfaces to form part of two adjacent switches, and each common contact means is turned on by depression of any one of the two adjacent depressing surfaces. In the switch device of the invention, the two common contact means are designed so that each is commonly provided for two switches and can be operated by depression of any one of two adjacent depressing surfaces. Hence, the switch device of the invention is simpler in construction and lower in manufacturing cost than the conventional switch device.

While the invention has been described in connection with the preferred embodiment, it will be obvious to those skilled in the art that various modifications and variations could be made in the switch device of the present invention without departing from the scope or spirit of the invention.

What is claimed is:

1. A switch device of the type having a flat rectangular operating knob provided on one surface of a switch casing, said operating knob being displaceable and slightly rotatable relative to said switch casing by depression and having four depressing surfaces defined by diagonal lines, said switch device further having four switches arranged inside said switch casing, depression of each of said four depressing surfaces operating a corresponding one of said four switches, said four switches comprising:

four principal contact means which are each aligned with a corresponding one of said depressing surfaces to each form part of one of said four switches, and each principal contact means being engaged upon depression of said corresponding depressing surface; and two common contact means which are arranged at substantially opposite ends of one of said diagonal lines of said operating knob, each of said two common contact means being aligned with two corresponding adjacent ones of said depressing surfaces to each form part of two adjacent ones of said four switches, and each of said two common contact means being engaged upon depression of either of said two corresponding adjacent depressing surfaces, wherein depression of each of said four depressing surfaces causes the corresponding one of said four principal contact means and the corresponding one of said two common contact means to be engaged, thereby operating the corresponding one of said four switches.

2. The switch device of claim 1, further comprising a regulating member which, when any one of the four depressing surfaces is depressed, prevents depression of a corresponding depressing surface.

3. The switch device of claim 2, wherein the regulating member has depression regulating portions, each of the depression regulating portions corresponding to one of the depressing surfaces, the operating knob of the switch device further comprising operating protrusions, each of the operating protrusions corresponding to one of the depressing surfaces, the operating protrusions being engageable with the depression regulating portions such that depression of one of the depressing surfaces causes the corresponding operating protrusion to abut against a corresponding depression regulating portion to move the regulating member toward an opposing operating protrusion to block depression of the opposing operating protrusion.

4. The switch device of claim 1, further comprising display means on each of the four depressing surfaces.

5. The switch device of claim 1, further comprising a slide switch, the slide switch being movable to a first position to connect a first stationary contact to a second stationary contact and to connect a third stationary contact to a fourth stationary contact, and the slide switch being movable to another position to connect the second stationary contact to a fifth stationary contact and the fourth stationary contact to a sixth stationary contact.

6. A switch device comprising:

four depressing surfaces;

four principal contact means, each principal contact means being aligned with a corresponding one of the four depressing surfaces and being engaged upon depression of the one corresponding depressing surface; and two common contact means, each common contact means being aligned with a corresponding adjacent two of the four depressing surfaces and being engaged upon depression of either of the two corresponding adjacent depressing surfaces, each of the four principal contact means forming part of one of four switches and each of the two common contact means forming part of two adjacent ones of said four switches, wherein depression of each of said four depressing surfaces causes the corresponding one of said four principal contact means and the corresponding one of said two common contact means to be engaged, thereby operating the corresponding one of said four switches.

7. The switch device of claim 6, wherein the depressing surfaces are defined by diagonal lines.

8. The switch device of claim 7, wherein the common contact means are arranged at substantially opposite ends of one of the diagonal lines.

9. The switch device of claim 6, further comprising an operating knob, the operating knob having the four depressing surfaces defined thereon and the operating knob being displaceable and slightly rotatable by depression.

10. The switch device of claim 9, wherein the operating knob is flat and rectangular.

11. The switch device of claim 9, wherein the operating knob is provided on one surface of a switch casing and the switches are arranged inside the switch casing.

12. The switch device of claim 9, wherein the depressing surfaces are defined by diagonal lines.

13. The switch device of claim 12, wherein the common contact means are arranged at substantially opposite ends of one of the diagonal lines.

14. The switch device of claim 6, further comprising a regulating member which, when any one of the four depressing surfaces is depressed, prevents depression of an opposing depressing surface.

15. The switch device of claim 14, wherein the regulating member has depression regulating portions, each of the depression regulating portions corresponding to one of the depressing surfaces, the switch device further comprising operating protrusions, each of the operating protrusions corresponding to one of the depressing surfaces, the operating protrusions being engageable with the depression regulating portions such that depression of one of the depressing surfaces causes the corresponding operating protrusion to abut against a corresponding depression regulating portion to move the regulating ember toward an opposing operating protrusion to block depression of the opposing operating protrusion.

16. The switch device of claim 15, wherein the depression regulating portions are tapered.

17. The switch device of claim 6, further comprising display means on each of the four depressing surfaces.

18. The switch device of claim 6, further comprising a slide switch, the slide switch being movable to a first position to connect a first stationary contact to a second stationary contact and to connect a third stationary contact to a fourth stationary contact, and the slide switch being movable to another position to connect the second stationary contact to a fifth stationary contact and the fourth stationary contact to a sixth stationary contact.

19. A switch device comprising:

a plurality of depressing surfaces;

a plurality of principal contact means, each principal contact means being aligned with a corresponding one of the plurality of depressing surfaces and being engaged upon depression of the one corresponding depressing surface; and at least one common contact means, each common contact means being aligned with a corresponding adjacent two of the plurality of depressing surfaces and being engaged upon depression of either of the two corresponding adjacent depressing surfaces, each of the plurality of principal contact means forming part of a corresponding one of a plurality of switches and the at least one common contact means forming part of two adjacent ones of said plurality of switches, wherein depression of each of said plurality of depressing surfaces causes the corresponding one of said plurality of principal contact means and the corresponding one of said at least one common contact means to be engaged, thereby operating the corresponding one of said plurality of switches.

20. The switch device of claim 19, further comprising a slide switch, the slide switch being movable to a first position to connect a first stationary contact to a second stationary contact and to connect a third stationary contact to a fourth stationary contact, and the slide switch being movable to another position to connect the second stationary contact to a fifth stationary contact and the fourth stationary contact to a sixth stationary contact.

* * * * *

UNITED STATES PATENT AND TRADEMARK OFFICE

CERTIFICATE OF CORRECTION

PATENT NO. : 5,034,572

DATED : July 23, 1991

INVENTOR(S) : YASUHIRO KOUNO ET AL.

It is certified that error appears in the above-identified patent and that said Letters Patent is hereby corrected as shown below:

Claim, 15, column 8, line 57 change "ember" to --member--.

Signed and Sealed this

Twenty-third Day of March, 1993

*Attest:*

STEPHEN G. KUNIN

*Attesting Officer*

*Acting Commissioner of Patents and Trademarks*